US007900790B2

(12) United States Patent
Carleton et al.

(10) Patent No.: US 7,900,790 B2
(45) Date of Patent: Mar. 8, 2011

(54) CLOSURE FOR PACKAGING CONTAINERS

(75) Inventors: Michael R. Carleton, Hartland, MI (US); Les J. Dow, Shelby Township, MI (US); David A. Biggie, Oxford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 314 days.

(21) Appl. No.: 12/130,326

(22) Filed: May 30, 2008

(65) Prior Publication Data

US 2009/0294445 A1 Dec. 3, 2009

(51) Int. Cl.
*B65D 6/00* (2006.01)
*B65D 8/14* (2006.01)
*B65D 43/22* (2006.01)

(52) U.S. Cl. ..... 220/4.28; 220/254.3; 229/125.37; 229/125.39

(58) Field of Classification Search ..... 220/4.27, 220/4.28, 254.3, 833, 834, 835; 229/125.37, 229/125.39, 198.3
See application file for complete search history.

(56) References Cited

U.S. PATENT DOCUMENTS 2,072,257 A * 3/1937 Greve ..... 292/91
2,688,507 A * 9/1954 Ashworth ..... 292/76
5,390,474 A 2/1995 Goggins

* cited by examiner

*Primary Examiner* — Anthony Stashick
*Assistant Examiner* — Madison L Wright
(74) *Attorney, Agent, or Firm* — Quinn Law Group, PLLC

(57) ABSTRACT

A closure for a container is provided, including a first closure member with a male feature protruding from a first interface surface thereof. A retaining ring is configured to mate with and thereby attach the first closure member to the first flap. A second closure member has a female feature configured to receive the male feature defined through a second interface surface thereof. The second closure member also has retention tangs configured to mate with and thereby attach the second container flap to the second closure member. The male feature includes a stem with two flexible tabs extending acutely outward from the stem on opposing sides thereof. The flexible tabs are configured to snap fit into the female feature. The first and second closure members are respectively oriented such that the male feature mates with and releasably locks to the female feature when the first and second flaps are closed.

20 Claims, 2 Drawing Sheets

CLOSURE FOR PACKAGING CONTAINERS

TECHNICAL FIELD OF THE INVENTION

The present invention relates generally to containers for packaging and transporting goods, and more specifically to devices for releasably and securely closing packaging containers.

BACKGROUND OF THE INVENTION

Virtually every product in today's industrialized society that is bought, sold, or used has been physically transported (i.e., shipped) at one point in time. Regardless of the type of shipping employed, whether it be freight by ground, air, or water, most goods are packaged in a protective container prior to actual shipping. For example, original equipment manufacturers (OEM) of automobiles ship large quantities of vehicle parts, such as stamped hoods, deck lids, roof panels, quarter panels, and door panels, from manufacturing plants to innumerable locations around the world. Due to the harsh nature of the shipping and handling process, manufacturers of vehicle parts expend a substantial amount of time and effort into the design of specialized containers and equipment for packaging parts as they leave the production line.

In standard packaging procedures, a stack of corrugated cardboard cartons, either unfolded or pre-erected, is placed near the discharge end of the manufacturer's processing line. A finished part is removed from the processing line and placed in the container and, if unfolded, the container is then formed, by folding, to surround the completed part. The outer closure flaps of the corrugated carton are thereafter secured to the inner closure flaps, for example, by a number of lines of adhesive or by a mechanical closure mechanism. In regard to the former, hot melt adhesives or thermoplastic materials are favored because they yield a quicker set and create stronger bonds, requiring less bonding material than many ordinary wet or cold glues. With respect to the latter, prior art practices are to employ metal or plastic straps, commercial-strength tape, or mating hook and loop-type fastening strips to securely seal the closure flaps of the packaging container.

SUMMARY OF THE INVENTION

According to one embodiment of the present invention, a closure device for a packaging container is provided. The container itself has a main body with two opposing side walls, an opening for providing access to the container, and first and second flaps each attached to a respective one of the side walls to transition between substantially closed positions, in which the first and second flaps at least partially overlap one another and thereby obstruct the opening, and generally open positions, in which the first and second flaps provide an at least partially unobstructed path through the opening.

The closure device includes a first closure member that is configured to attach to the first flap. The first closure member has a male feature protruding from a first interface surface thereof. The closure device also includes a second closure member configured to attach to the second flap. The second closure member has a female feature defined through a second interface surface thereof, which is configured to receive and mate with the male feature. The male feature includes a stem portion attached at a first end to, and extending generally perpendicularly outward from the first interface surface. At least one tab, which extends obliquely outward from a second end of the stem portion, is configured to snap fit with and releasably lock to the female feature and thereby secure the first flap to the second flap in the closed positions.

According to one aspect of the present embodiment, the closure device also includes a retaining ring that is configured to mate with and thereby attach the first closure member to the first flap. In this instance, the first closure member preferably includes a plurality of snap fasteners that protrude generally orthogonally outward therefrom. The snap fasteners are configured to snap fit with the retaining ring. Moreover, the retaining ring preferably has a stepped region extending inward from at least a portion of an inner peripheral edge thereof. The stepped region is configured to receive and mate with the plurality of snap fasteners to thereby attach the retaining ring to the first closure member.

In another aspect of the present embodiment, the closure device preferably includes first and second flexible tab members each extending acutely outward from the second end of the stem, on opposing sides thereof. Ideally, the male feature further includes at least one pair of risers protruding outward on opposing sides of the stem portion. The risers are configured to limit rotational movement of the second closure member when the male feature mates with and releasably locks to the female feature.

According to another aspect of the present embodiment, the first interface surface of the first closure member includes a recessed stratum. The recessed stratum is configured to abut against the second interface surface in a flush fit manner when the male feature mates with and releasably locks to the female feature.

According to yet another aspect of the present embodiment, the first closure member includes a first key-indexing feature that is configured to ensure the first closure member is properly oriented when attached to the first flap so that the male feature can accurately mate with and releasably lock to the female feature when the first and second flaps are in respective closed positions. Ideally, the first key-indexing feature includes a blade wall extending generally orthogonally outward from the first closure member. The blade wall is configured to mate with a complimentary hole formed in the first flap.

In accordance with yet another aspect of the present embodiment, the second closure member includes a second key-indexing feature that is configured to ensure the second closure member is properly oriented when attached to the second flap so that the female feature can accurately receive and mate with the male feature when the first and second flaps are in respective closed positions. Ideally, the second key-indexing feature includes a plurality of walls each extending generally orthogonally outward from the second flap, which are configured to mate with a complimentary hole formed in the second flap. Alternatively, or in addition thereto, the second key-indexing feature may include a protrusion extending outward from the second closure member, and configured to mate with a complimentary aperture formed in the second flap.

In another aspect of the present embodiment, the second closure member further includes a cavity defined, at least in part, by the plurality of walls which extend between the first interface surface and a fourth interface surface of the second closure member. The cavity is configured to allow for selective release of the male feature from the female feature.

According to yet another aspect, the second closure member further includes an elevated platform which protrudes from a fifth interface surface, which opposes the second interface surface, and surrounds the female feature. The elevated platform is configured to abut against the tabs when the male feature mates with and releasably locks to the female feature. The elevated platform improves the retention characteristics of the closure device.

In accordance with yet another aspect of the present embodiment, the second closure member further includes a plurality of spaced retention tangs that are configured to mate with and thereby attach the second closure member to the second flap.

According to another embodiment of the present invention, a container for packaging manufactured goods is described. The container includes a main body having first and second opposing side walls, a bottom wall extending between and attached to respective first ends of the first and second side walls, and a top wall extending between and attached to respective second ends of the first and second side walls. The first and second side walls, in cooperation with the bottom and top walls, define at least one opening that is configured to provide access to the container. First and second flaps are attached to a respective one of the first and second side walls to transition between substantially closed positions, in which the first and second flaps at least partially overlap one another and thereby obstruct the at least one opening, to generally open positions, in which the first and second flaps provide an at least partially unobstructed path through the at least one opening.

A first closure member is attached to or integrated with the first flap. The first closure member has a male feature protruding from a first interface surface thereof. A second closure member is attached to or integrated with the second flap. The second closure member has a female feature defined through a second interface surface thereof. The female feature is configured to receive and mate with the male feature. The male feature includes a stem portion attached at a first end to and extending generally perpendicularly outward from the first interface surface. First and second flexible tab members each extend acutely outward from a second end of the stem portion, on opposing sides thereof. The first and second flexible tab members are configured to snap fit into the female feature. The first and second closure members are respectively oriented along the first and second flaps such that the male feature mates with and releasably locks to the female feature securing the first and second flaps in their respective closed positions.

Preferably, the container also includes a retaining ring that is configured to mate with and thereby attach the first closure member to the first flap. The retaining ring has a stepped region extending inward from at least a portion of an inner peripheral edge thereof. In this instance, the first closure member also includes a plurality of snap fasteners protruding generally orthogonally outward therefrom that are configured to snap fit with the retaining ring and thereby attach the first closure member to the retaining ring.

According to another aspect of the present embodiment, the first closure member also includes a first key-indexing feature having a blade wall extending generally orthogonally outward from the first closure member in a continuous manner about the first interface surface. The first key-indexing feature is configured to mate with a complimentary hole formed in the first flap to thereby ensure the first closure member is properly oriented when attached to the first flap.

In accordance with another aspect, the second closure member further includes a second key-indexing feature having a plurality of walls each extending generally orthogonally outward from the second closure member, and spaced about the second interface surface. The plurality of walls are configured to mate with a complimentary hole formed in the second flap to thereby ensure the second closure member is properly oriented when attached to the second flap.

The above features and advantages, and other features and advantages of the present invention will be readily apparent from the following detailed description of the preferred embodiments and best modes for carrying out the present invention when taken in connection with the accompanying drawings and appended claims.

DESCRIPTION OF THE PREFERRED EMBODIMENTS

Figure 1:
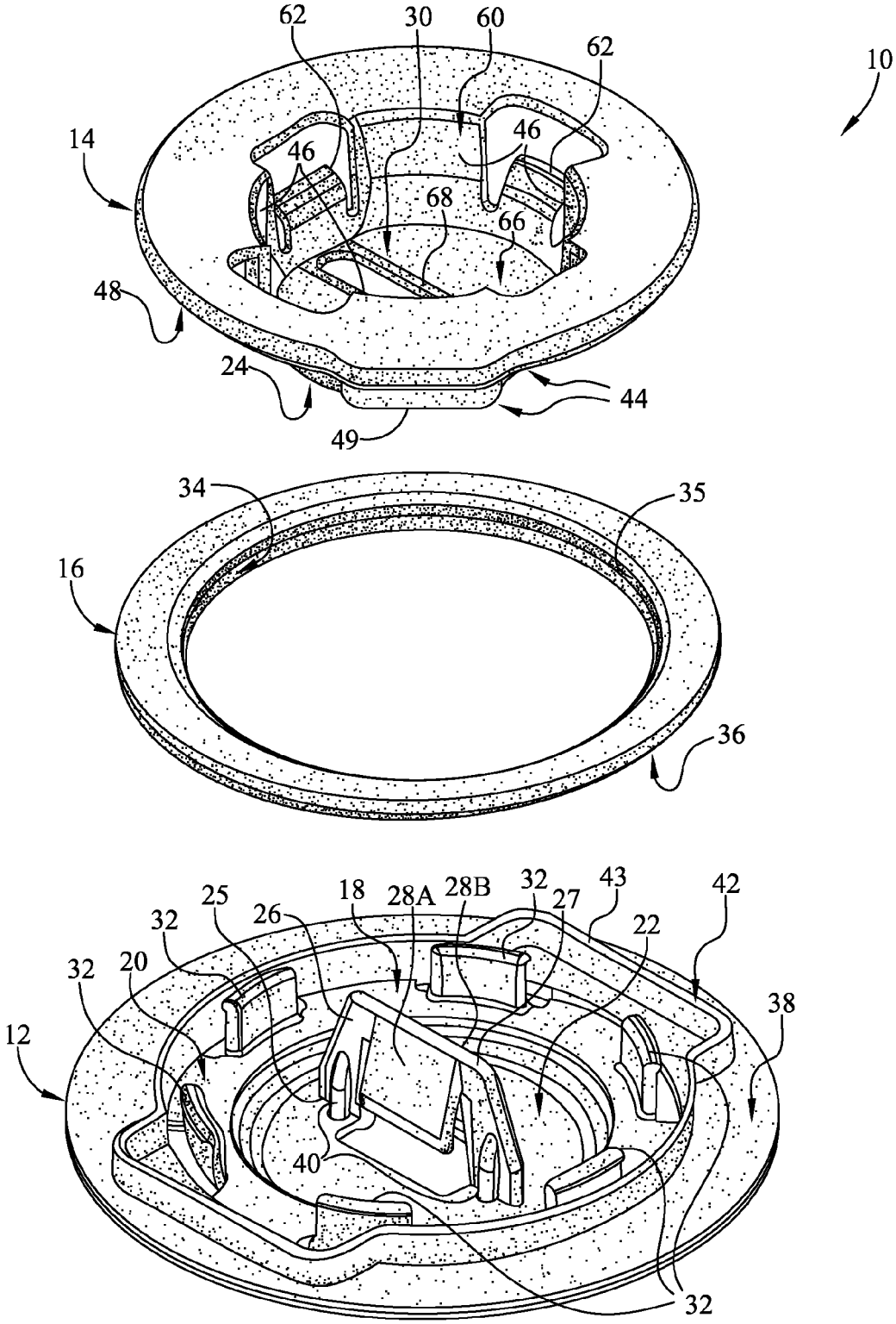
FIG. 1 is a an exploded isometric illustration of a male-female closure device in accordance with a preferred embodiment of the present invention.
Figure 3:
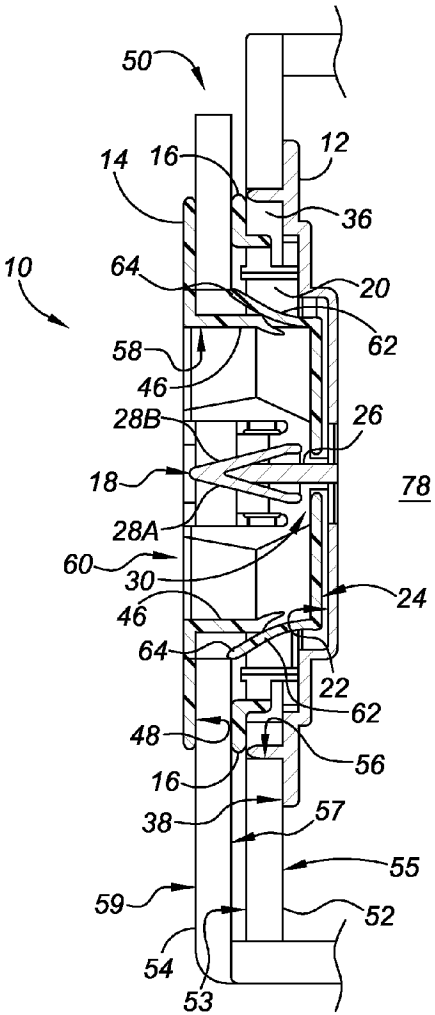
FIG. 3 is a cross-sectional illustration of the packaging container with male-female closure device of FIG. 2 taken along line 1-1.
Figure 2:
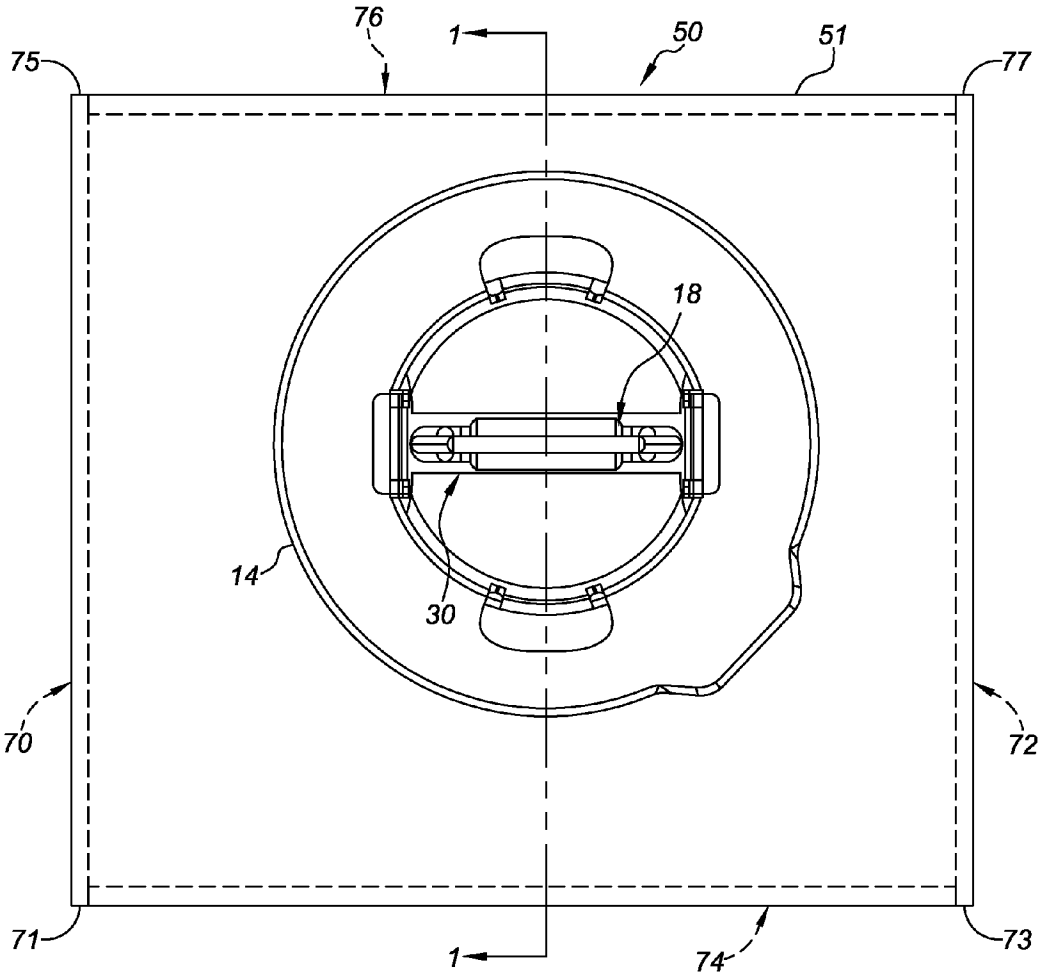
FIG. 2 is a front-view illustration of an exemplary packaging container with the male-female closure device of FIG. 1 integrated thereto.

Referring to the drawings, wherein like reference numbers refer to like components throughout the several views, FIG. 1 is an exploded isometric illustration of a male-female closure device, identified generally as 10, in accordance with a preferred embodiment of the present invention. The closure device 10 is intended for integration into a pre-erected cardboard container for packaging and transporting large sheet metal stampings, such as, but not limited to, stamped vehicle hoods, deck lids, roof panels, quarter panels, and door panels. However, it should be recognized that the present invention may be integrated into other packaging containers having various sizes and configurations, and fabricated from an infinite variety of materials. In addition, the drawings presented herein—i.e., FIGS. 1 through 3, are not to scale and are provided purely for instructional purposes. Thus, the specific and relative dimensions shown in the drawings are not to be considered limiting.

The closure device 10 consists of two primary components—a first or inner flap detail, referred to herein as first closure member 12 and a second or outer flap detail, referred to herein as second closure member 14, each configured to attach to or be integrated with a respective lid or flap of a packaging container (e.g., first and second flaps 52 and 54 of FIG. 3). Both the first and second closure members 12, 14 are preformed, single-piece, substantially circular members, each constructed from a material known to have a suitable strength for the intended use of the closure device 10, such as, but not limited to, high strength plastics (e.g., polyurethane, polyvinyl chloride, and polyethylene), metallic materials (e.g., brushed steel or aluminum), etc. It is also within the scope of the present invention that the first and second closure members 12, 14 be fabricated from numerous constituent components that are assembled into a single, unitary structure. Moreover, the first and second closure members 12, 14 may individually or collectively take on additional functional shapes (e.g., rectangular, elliptical, or pentagonal) without departing from the scope of the present invention.

Still referring to FIG. 1, the first closure member 12 includes a first interface surface, defined herein by a landing portion 20 surrounding or encircling a stepped or recessed stratum 22. As will be understood from the following description, the first interface surface is configured (i.e., contoured and dimensioned) to mate with a complimentary second interface surface 24 of the second closure member 14 (best seen in FIG. 3). By way of example, the recessed stratum 22, according to the preferred embodiment of FIG. 1, is configured to abut against the second interface surface 24 in a flush fit manner when the first and second closure members 12, 14 are in a mating relation. The depth of the recessed stratum 22 may be selectively modified depending upon the particular dimensions of the flap to which the first closure member 12 is to be attached.

The first closure member 12 has a male feature 18, which is also referred to herein as a "barb", protruding from the first interface surface. Specifically, the male feature 18 includes a stem portion 26 attached at a first end 25 to, and extending generally perpendicularly outward from the recessed stratum 22. At least one, but preferably two flexible and elastic tab members 28A and 28B each extend obliquely outward, preferably in an acute manner, from a second end 27 of the stem portion 26, on opposing sides thereof. The male feature 18, namely first and second flexible tab members 28A, 28B, is configured to snap fit with and releasably lock to a female feature 30, as more clearly seen in FIG. 3. The female feature 30 (also referred to as a "slot" or "slotting feature"), which is formed in or defined through the second interface surface 24 of the second closure member 14, is configured (i.e., dimensioned and contoured) to receive and mate with the male feature 18.

Preferably, the closure device 10 also includes a retaining ring 16, which is configured to mate with and thereby attach the first closure member to the first flap 52 of container 50 (FIG. 3). Similar to the first and second closure members 12, 14, the retaining ring 16 of FIG. 1 is a preformed, single-piece, substantially circular and toroidal member, fabricated from a material of suitable strength for the intended use of the closure device 10, such as, but not limited to, high strength plastics (e.g., polyurethane, polyvinyl chloride, and polyethylene), metallic materials (e.g., brushed steel or aluminum), etc. According to the embodiment of FIG. 1, the first closure member 12 employs a plurality of snap fasteners 32, which protrude generally orthogonally outward from the landing portion 20, that are configured to snap fit with the retaining ring 16. To this regard, the retaining ring 16 has a stepped region, indicated generally at 34 in FIG. 1, which extends inward from at least a portion of an inner peripheral edge 35 thereof. In accordance with preferred practices, the step region 34 extends continuously about the inner peripheral edge 35, and is configured (e.g., contoured) to receive and mate with the plurality of snap fasteners 32, thereby attaching the retaining ring 16 to the first closure member 12. When the retaining ring 16 attaches to (i.e., snap fits into locking engagement with) the first closure member 12, as seen in FIG. 3, an inner surface 36 of the retaining ring 16 presses and abuts against an outer surface 53 of the first flap 52, while a third interface surface 38 of the first closure member 12 presses and abuts against an opposing inner surface 55 of the first flap 52, mechanically locking the first closure member 12 to the first flap 52.

The male feature 18 also includes at least one, but preferably two pairs of risers 40 protruding outward from opposing sides of the stem portion 26 (only one of each pair of risers 40 is shown in FIG. 1). The risers 40 are configured (e.g., dimensioned and positioned) to limit rotational movement of the second closure member 14 when the male feature 18 mates with and releasably locks to the female feature 30. By way of example, when the first and second flexible tab members 28A, 28B are received by and snap fit into the female feature 30, each pair of risers 40 presses or abuts against a different, rotationally opposing section of an inner peripheral edge of the female feature 30, limiting or eliminating any rotational movement of the second closure member 14.

With continuing reference to FIG. 1, the first closure member 12 also includes a first key-indexing feature, identified generally by reference numeral 42. According to the preferred embodiment of the present invention, the first key-indexing feature 42 consists essentially of a blade wall 43 which protrudes generally orthogonally outward from the first closure member 12, between the first interface surface (i.e., landing 20) and the third interface surface 38, extending in a continuous manner about the recessed stratum 22. The first key-indexing feature 42 is configured to ensure that the first closure member 12 is properly oriented when attached to the first flap 52 so that the male feature 18 can accurately mate with and releasably lock to the female feature 30 when the first and second flaps 52, 54 are closed. For example, the blade wall 43 is designed to be geometrically coextensive with a complimentary hole or keyway 56 (FIG. 3) that is pre-formed at a predetermined location in the first flap 52.

Similar to the first closure member 12, the second closure member 14 includes a second key-indexing feature, identified generally at 44 in FIG. 1. The second key-indexing feature 44 is configured to ensure that the second closure member 14 is properly oriented when attached to the second flap 54 (FIG. 3) such that the female feature 30 can accurately receive and mate with the male feature 18 when the first and second flaps 52, 54 are closed. According to the preferred embodiment illustrated in FIG. 1, the second key-indexing feature 44 includes a plurality of walls 46 each extending generally orthogonally outward from the second flap 14, between the second interface surface 24 and a fourth interface surface 48. The plurality of walls 46 are configured to mate with (i.e., designed to be geometrically coextensive with) a complimentary hole 58 pre-formed at a predetermined location in the second flap 54, as best seen in FIG. 3. Alternatively, or in addition to the plurality of walls 46, the second key-indexing feature 44 includes a protrusion 49, which extends outward from the second closure member 14 (i.e., protruding from a portion of the fourth interface surface 48), configured to mate with a complimentary aperture formed in the second flap 54. It should be readily understood that the first and second key-indexing features 42, 44 may be individually or collectively modified to suit the particular application to which the present invention is to be integrated. Moreover, the first and second key-indexing features 42, 44 may be wholly eliminated from the first and second closure members 12, 14, respectively, in an instance where the first closure member 12 and first flap 52 and second closure member 14 and second flap 54 are pre-formed as single-piece, unitary structures.

A closure device according to the present invention simultaneously addresses three primary design concerns: ergonomics, tact time to close, and shipping performance. The male-female closure device 10 eliminates ergonomic stressors created while closing the packaging container 50. In addition, the tact time to close and properly seal the container 50 is shorter than any other current method being employed. Finally, the present design utilizes a mechanical bond to attach the closure device 10 to the container 50, eliminating adhesives that may delaminate while the container 50 is in use.

The second closure member 14 also includes a cavity, indicated generally at 60 in FIG. 1, which is defined, at least in part, by the plurality of walls 46 that extend between the second and fourth interface surfaces 24, 48 of the second closure member 14. The cavity 60 is configured to allow for selective release of the male feature 18 from the female feature 30. Specifically, a user of the packaging container 50 may insert, for example, a thumb and index finger into the cavity 60, compress the flexible tab members 28A, 28B, and selectively release male feature 18 from the female feature 30.

The second closure member 14 also includes a plurality of retention tangs 62 spaced about and extending from a fifth interface surface 66 opposing the second interface surface 24, and interspersed between the plurality of walls 46. The retention tangs 62 are configured to mate with and thereby attach the second closure member 14 to the second flap 54. For example, when the second closure member 14 is inserted into the complimentary hole 58 formed in the second flap 54, as seen in FIG. 3, an upper lip 64 of each retention tang 62 presses and abuts against an inner surface 57 of the second flap 54, while the fourth interface surface 48 of the second closure member 14 presses and abuts against an opposing outer surface 59 of the second flap 54, mechanically locking the second closure member 14 to the second flap 54.

According to preferred practices, the second flap 14 detail also includes an elevated platform 68, which protrudes from the fifth interface surface 66, and surrounds the female feature 30. The elevated platform 68 is configured to abut against the flexible tab members 28A, 28B when the male feature 18 mates with and releasably locks to said female feature 30. In so doing, the elevated platform 68 improves the retention characteristics of the closure device 10.

An exemplary packaging container 50 with the male-female closure device 10 of FIG. 1 integrated thereto is illustrated in FIG. 2. The container 50 includes a main body 51 having a first side wall (shown hidden in FIG. 2 and indicated as 70) opposing a second side wall (shown hidden in FIG. 2 and indicated as 72). A bottom wall (shown hidden in FIG. 2 at 74) extends between, and is attached, adhered, or formed to respective first ends 71 and 73 of the first and second side walls 70, 72. In addition, a top wall (shown hidden in FIG. 2 at 76) extends between, and is attached, adhered, or formed to respective second ends 75 and 77 of the first and second side walls 70, 72. The first and second side walls 70, 72, in cooperation with the bottom and top walls 74, 76, define at least one opening 78 (FIG. 3) to provide access to the container 50. The first and second flaps 52, 54 are attached to a respective one of the first and second side walls 70, 72 to transition between substantially closed positions, in which the flaps 52, 54 at least partially overlap one another and thereby obstruct the opening 78 (as seen in FIG. 2), to generally open positions, in which the flaps 52, 54 provide an at least partially unobstructed path through the opening (not shown). The first and second closure members 12, 14 are respectively oriented along the first and second flaps 52, 54 such that the male feature properly mates 18 with and releasably locks to the female feature 30 when the flaps 52, 54 are closed.

While the best modes for carrying out the present invention have been described in detail, those familiar with the art to which this invention relates will recognize various alternative designs and embodiments for practicing the invention within the scope of the appended claims.

The invention claimed is:

1. A closure device for a container having a main body with two opposing side walls, at least one opening defined by the main body to provide access to the container, and first and second flaps each operatively attached to a respective one of the side walls to transition between substantially closed positions and generally open positions, comprising:

a first closure member configured to operatively attach to the first flap, said first closure member having a male feature protruding from a first interface surface thereof; and a second closure member configured to operatively attach to the second flap, said second closure member having a female feature defined through a second interface surface thereof, said female feature being configured to receive and mate with said male feature;

wherein said male feature includes a stem portion attached at a first end to and extending generally perpendicularly outward from said first interface surface, and at least one tab extending obliquely outward from a second end of said stem portion, said at least one tab being configured to snap fit with and releasably lock to said female feature and thereby secure the first flap to the second flap in the closed positions.

2. The closure device of claim 1, further comprising:

a retaining ring configured to mate with and thereby attach said first closure member to the first flap.

3. The closure device of claim 2, wherein said first closure member further includes a plurality of snap fasteners protruding generally orthogonally outward therefrom and configured to snap fit with said retaining ring.

4. The closure device of claim 3, wherein said retaining ring has a stepped region extending inward from at least a portion of an inner peripheral edge thereof, said step region being configured to receive and mate with said plurality of snap fasteners to thereby attach said retaining ring to said first closure member.

5. The closure device of claim 1, wherein said at least one tab includes first and second flexible tab members each extending acutely outward from said second end of said stem portion on opposing sides thereof.

6. The closure device of claim 1, wherein said male feature further includes at least one pair of risers protruding outward from opposing sides of said stem portion, said risers being configured to limit rotational movement of said second closure member when said male feature mates with and releasably locks to said female feature.

7. The closure device of claim 1, wherein said first interface surface includes a recessed stratum configured to abut against said second interface surface in a flush fit manner when said male feature mates with and releasably locks to said female feature.

8. The closure device of claim 1, wherein said first closure member further includes a first key-indexing feature configured to ensure said first closure member is properly oriented when operatively attached to the first flap such that said male feature can mate with and releasably lock to said female feature when the first and second flaps are in respective closed positions.

9. The closure device of claim 8, wherein said first key-indexing feature includes a blade wall extending generally orthogonally outward from said first closure member to mate with a complimentary hole formed in the first flap.

10. The closure device of claim 1, wherein said second closure member further includes a second key-indexing feature configured to ensure said second closure member is properly oriented when operatively attached to the second flap such that said female feature can receive and mate with said male feature when the first and second flaps are in respective closed positions.

11. The closure device of claim 10, wherein said second key-indexing feature includes a plurality of walls extending generally orthogonally outward from said second closure member and configured to mate with a complimentary hole formed in the second flap.

12. The closure device of claim 10, wherein said second key-indexing feature includes a protrusion extending outward from said second closure member and configured to mate with a complimentary aperture formed in the second flap.

13. The closure device of claim 1, wherein said second closure member further includes a cavity defined at least in part by a plurality of walls extending between said second interface surface and a fourth interface surface of said second closure member, said cavity being configured to allow for selective release of said male feature from said female feature.

14. The closure device of claim 1, wherein said second closure member further includes a plurality of retention tangs configured to mate with and thereby attach said second closure member to the second flap.

15. The closure device of claim 1, wherein said second closure member further includes an elevated platform protruding from a fifth interface surface and surrounding said female feature, said elevated platform configured to abut against said at least one tab when said male feature mates with and releasably locks to said female feature.

16. A container for packaging manufactured goods, comprising:

a main body portion having first and second opposing side walls, a bottom wall extending between and attached to respective first ends of said first and second side walls, and a top wall extending between and attached to respective second ends of said first and second side walls, said first and second side walls and said bottom and top walls defining at least one opening that is configured to provide access to the container;

first and second flaps operatively attached to a respective one of said first and second side walls to transition between substantially closed positions, in which said first and second flaps at least partially overlap one another and thereby obstruct said at least one opening, to generally open positions, in which said first and second flaps provide an at least partially unobstructed path through said at least one opening;

a first closure member operatively attached to said first flap, said first closure member having a male feature protruding from a first interface surface thereof; and a second closure member operatively attached to said second flap, said second closure member having a female feature defined through a second interface surface thereof, said female feature being configured to receive and mate with said male feature;

wherein said male feature includes a stem portion attached at a first end to and extending generally perpendicularly outward from said first interface surface, and first and second flexible tab members each extending acutely outward from said second end on opposing sides of said stem portion, said first and second flexible tab members being configured to snap fit with said female feature; and wherein said first and second closure members are respectively oriented along said first and second flaps such that said male feature mates with and releasably locks to said female feature securing said first and second flaps in respective closed positions.

17. The container of claim 16, further comprising:

a retaining ring configured to mate with and thereby attach said first closure member to the first flap, said retaining ring having a stepped region extending inward from at least a portion of an inner peripheral edge thereof;

wherein said first closure member further includes a plurality of snap fasteners protruding generally orthogonally outward therefrom and configured to snap fit with said retaining ring and thereby attach said retaining ring to said first closure member.

18. The container of claim 16, wherein said first closure member further includes a first key-indexing feature having a blade wall extending generally orthogonally outward from said first closure member in a continuous manner about said first interface surface and configured to mate with a complimentary first hole formed in the first flap to thereby ensure said first closure member is properly oriented when attached to said first flap.

19. The container of claim 16, wherein said second closure member further includes a second key-indexing feature having a plurality of walls each extending generally orthogonally outward from said second closure member and spaced about said second interface surface, said plurality of walls being configured to mate with a complimentary hole formed in the second flap to thereby ensure said second closure member is properly oriented when attached to said second flap.

20. A closure device for a container having a main body with two opposing side walls, at least one opening defined by the main body, and first and second flaps each being operatively attached to a respective one of the side walls to transition between a substantially closed position and a generally open position, comprising:

a first closure member having a plurality of snap fasteners protruding generally orthogonally outward therefrom, said first closure member having a male feature protruding from a first interface surface thereof;

a retaining ring configured to mate with and thereby attach said first closure member to the first flap, said retaining ring having a stepped region extending inward from an inner peripheral edge thereof and configured to receive and mate with said plurality of snap fasteners to thereby attach said retaining ring to said first closure member; and a second closure member having a plurality of spaced retention tangs configured to mate with and thereby attach said second closure member to the second flap, said second closure member having a female feature defined through a second interface surface thereof that is configured to receive and mate with said male feature;

wherein said male feature includes a stem portion attached at a first end to and extending generally perpendicularly outward from said first interface surface, and first and second flexible tab members each extending acutely outward from a second end of said stem portion on opposing sides thereof, said first and second flexible tab members being configured to snap fit with and releasably lock to said female feature and thereby secure the first flap to the second flap in the closed positions.

* * * * *